US007238293B2

(12) United States Patent
Donaldson et al.

(10) Patent No.: US 7,238,293 B2
(45) Date of Patent: Jul. 3, 2007

(54) SLOTTED SUBSTRATE AND METHOD OF MAKING

(75) Inventors: Jeremy Donaldson, Corvallis, OR (US); Martha A. Truninger, Corvallis, OR (US); Jeffrey S. Obert, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 146 days.

(21) Appl. No.: 10/601,148

(22) Filed: Jun. 20, 2003

(65) Prior Publication Data

US 2004/0084404 A1 May 6, 2004

Related U.S. Application Data

(62) Division of application No. 10/283,767, filed on Oct. 30, 2002, now Pat. No. 6,648,454.

(51) Int. Cl.
*B41J 2/16* (2006.01)

(52) U.S. Cl. ..... 216/27; 216/41; 216/49; 216/51; 216/79; 216/99

(58) Field of Classification Search ..... 216/2, 216/27, 40, 41, 47, 49, 51, 52, 53, 56, 57, 216/67, 79, 99; 29/890.1; 219/121.69; 438/21
See application file for complete search history.

(56) References Cited

U.S. PATENT DOCUMENTS

| | | | | |
|---|---|---|---|---|
| 5,006,202 | A * | 4/1991 | Hawkins et al. | 216/27 |
| 6,019,457 | A * | 2/2000 | Silverbrook | 347/65 |
| 6,074,038 | A | 6/2000 | Takada et al. | |
| 6,107,209 | A | 8/2000 | Ohkuma | |
| 6,260,956 | B1 | 7/2001 | Narang et al. | |
| 6,273,557 | B1 * | 8/2001 | Milligan et al. | 347/65 |
| 6,303,042 | B1 * | 10/2001 | Hawkins et al. | 216/27 |
| 2003/0141279 | A1 * | 7/2003 | Miller et al. | 216/58 |

FOREIGN PATENT DOCUMENTS

| | | |
|---|---|---|
| EP | 0 841 167 | 5/1998 |
| EP | 1226946 | 7/2003 |
| GB | 2384752 | 8/2003 |
| GB | 2384753 | 8/2003 |
| GB | 2393147 | 3/2004 |

OTHER PUBLICATIONS

GB Search Report for APP 0325044.6,1 Apr. 5, 2004.

* cited by examiner

*Primary Examiner*—Anita Alanko

(57) ABSTRACT

The described embodiments relate to a slotted substrate and methods of forming same. One exemplary method patterns a hardmask on a first substrate surface sufficient to expose a first area of the first surface and forms a slot portion in the substrate through less than an entirety of the first area of the first surface. The slot portion has a cross-sectional area at the first surface that is less than a cross-sectional area of the first area. After forming the slot portion, the method etches the substrate to remove material from within the first area to form a fluid-handling slot.

25 Claims, 7 Drawing Sheets

SLOTTED SUBSTRATE AND METHOD OF MAKING

RELATED CASES

This patent application is a divisional claiming priority from a patent application having Ser. No. 10/283,767 titled "Slotted Substrate and Method of Making" filed Ser. No. 10/30/2002, and issued as U.S. Pat. No. 6,648,454.

BACKGROUND

Inkjet printers and other printing devices have become ubiquitous in society. These printing devices can utilize a slotted substrate to deliver ink in the printing process. Such printing devices can provide many desirable characteristics at an affordable price. However, the desire for more features at ever-lower prices continues to press manufacturers to improve efficiencies.

Currently, the slotted substrates can have a propensity to suffer malfunctions due to, among other things, ink occlusion within individual slots. Such malfunctions can decrease product reliability and customer satisfaction.

Accordingly, the present invention arose out of a desire to provide slotted substrates having desirable characteristics.

BRIEF DESCRIPTION OF THE DRAWINGS

The same components are used throughout the drawings to reference like features and components.

DETAILED DESCRIPTION

Overview

The embodiments described below pertain to methods and systems for forming slots in a substrate. Several embodiments of this process will be described in the context of forming fluid-handling slots in a substrate that can be incorporated into a print head die or other fluid-ejecting device.

As commonly used in print head dies, the substrate can comprise a semiconductor substrate that can have microelectronics incorporated within, deposited over, and/or supported by the substrate on a thin-film surface that can be opposite a back surface or backside. The fluid-handling slot(s) can allow fluid, commonly ink, to be supplied from an ink supply or reservoir to fluid-ejecting elements proximate to ejection chambers within the print head.

In some embodiments, this can be accomplished by connecting the fluid-handling slot to one or more ink feed passageways, each of which can supply an individual ejection chamber. The fluid-ejecting elements commonly comprise heating elements, such as firing resistors, that heat fluid causing increased pressure in the ejection chamber. A portion of that fluid can be ejected through a firing nozzle with the ejected fluid being replaced by fluid from the fluid-handling slot. Bubbles can be formed in the ink or fluid as a byproduct of the ejection process. If the bubbles accumulate in the fluid-handling slot they can occlude ink flow to some or all of the ejection chambers and cause the print head to malfunction.

In one embodiment, the fluid-handling slots can have a configuration that can reduce bubble accumulation and/or promote bubbles to migrate out of the slots. The slots can be formed utilizing a hybrid or combination process. A hybrid process can use more than one substrate machining method, e.g. dry etch, wet etch, laser, saw, sand drill to achieve a slot geometry.

Exemplary Printing Device

Figure 1:
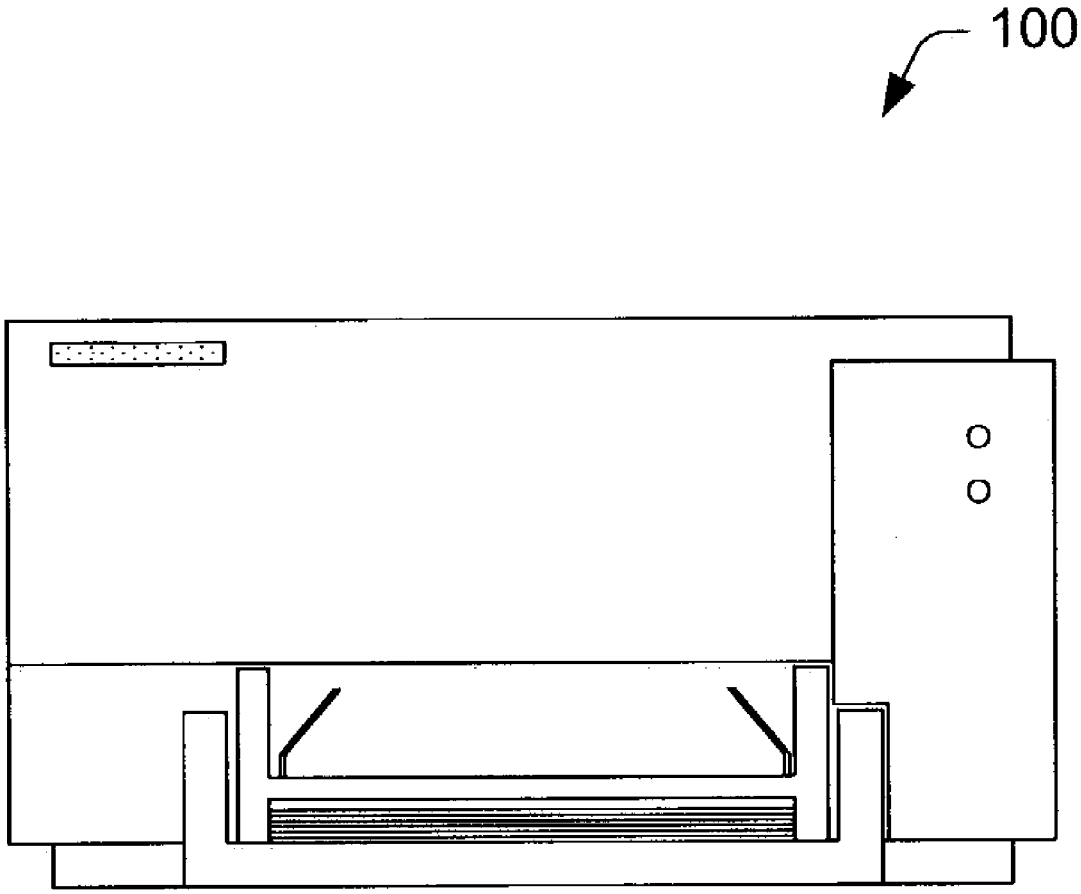
FIG. 1 shows a front elevational view of an exemplary printer in accordance with one embodiment.

FIG. 1 shows an exemplary printing device that can utilize an exemplary slotted substrate. In this embodiment, the printing device comprises a printer 100. The printer shown here is embodied in the form of an inkjet printer. The printer can be, but need not be, representative of an inkjet printer series manufactured by the Hewlett Packard Company under the trademark "DeskJet". The printer 100 can be capable of printing in black-and-white and/or in black-and-white as well as color. The term "printing device" refers to any type of printing device and/or image forming device that employs slotted substrate(s) to achieve at least a portion of its functionality. Examples of such printing devices can include, but are not limited to, printers, facsimile machines, photocopiers, and other fluid-ejecting devices.

Exemplary Embodiments and Methods

Figure 2:
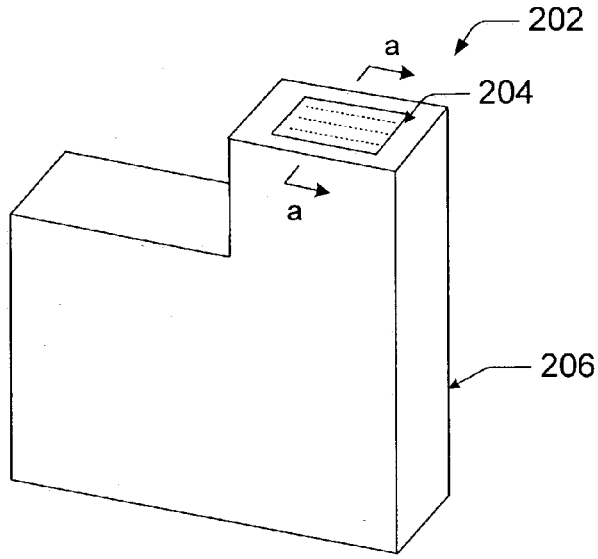
FIG. 2 shows a perspective view of a print cartridge in accordance with one embodiment.

FIG. 2 shows an exemplary print cartridge 202 that can be utilized in an exemplary printing device. The print cartridge is comprised of a print head 204 and a cartridge body 206 that supports the print head. Other exemplary configurations will be recognized by those of skill in the art.

Figure 3:
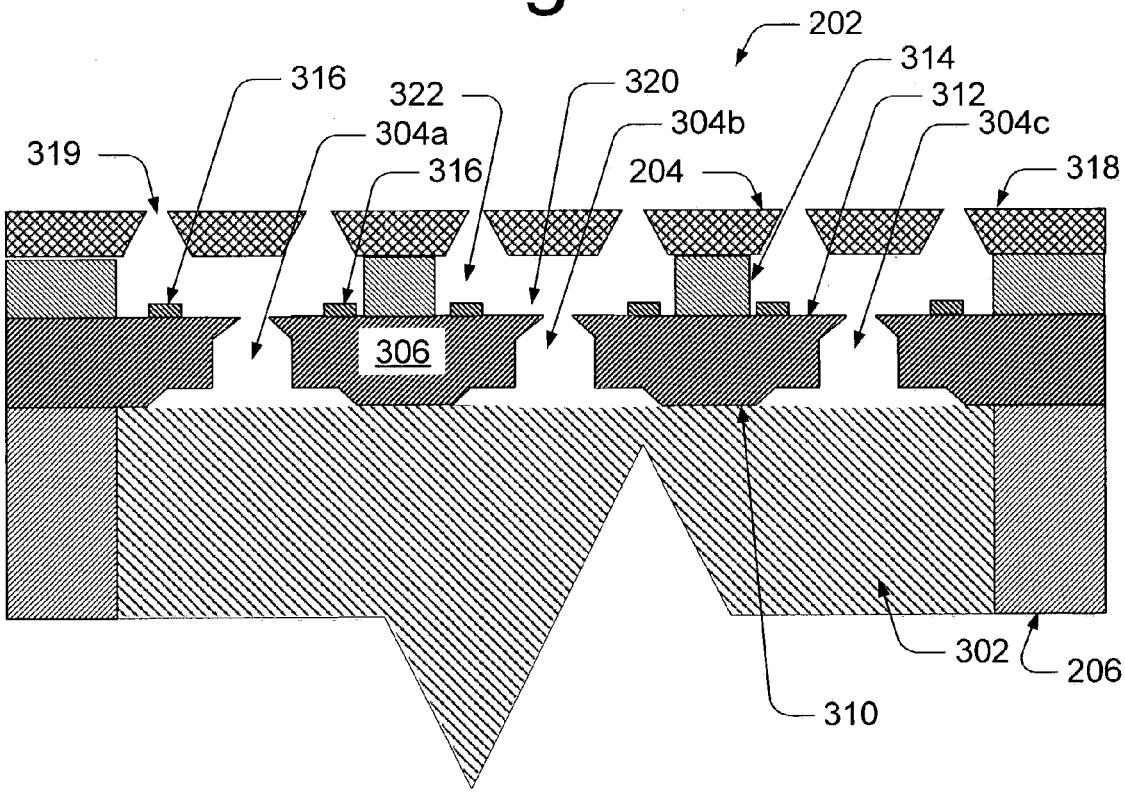
FIG. 3 shows a cross-sectional view of a top portion of a print cartridge in accordance with one embodiment.

FIG. 3 shows a cross-sectional representation of a portion of the exemplary print cartridge 202 taken along line a—a in FIG. 2. It shows the cartridge body 206 containing fluid 302 for supply to the print head 204. In this embodiment, the print cartridge is configured to supply one color of fluid or ink to the print head. In other embodiments, as described above, other exemplary print cartridges can supply multiple colors and/or black ink to a single print head. Other printers can utilize multiple print cartridges each of which can supply a single color or black ink. In this embodiment, a number of different fluid-handling slots are provided, with three exemplary slots being shown at 304*a*, 304*b*, and 304*c*. Other exemplary embodiments can divide the fluid supply so that each of the three fluid-handling slots receives a separate fluid supply. Other exemplary print heads can utilize less or more slots than the three shown here.

The various fluid-handling slots (304*a*–*c*) pass through regions of a substrate 306. In this exemplary embodiment, silicon can be a suitable substrate. In some embodiments, substrate 306 comprises a crystalline substrate such as doped or non-doped monocrystalline silicon or doped or non-doped polycrystalline silicon. Examples of other suitable substrates include, among others, gallium arsenide, gallium phosphide, indium phosphide, glass, silica, ceramics, or a semi-conducting material. The substrate can comprise various configurations as will be recognized by one of skill in the art.

The exemplary embodiments can utilize substrate thicknesses ranging from less than 100 microns to more than 2000 microns. One exemplary embodiment can utilize a substrate that is approximately 675 microns thick.

In some exemplary embodiments, the substrate comprises a base layer, such as a silicon substrate, upon which the other layers can be formed. The substrate has a first surface 310 and a second surface 312. Various layers formed above the second surface 312 are commonly referred to as "thin film layers". In some of these embodiments, one of the thin film layers is the barrier layer 314. In one such embodiment, the barrier layer can surround independently controllable fluid ejection elements or fluid drop generators. In this embodiment, the fluid ejection elements comprise firing resistors 316. This is but one possible exemplary configuration of thin film layers, other suitable examples will be discussed below.

The barrier layer 314 can comprise, among other things, a photo-resist polymer substrate. In some embodiments, above the barrier layer is an orifice plate 318. In one embodiment, the orifice plate comprises a nickel substrate. In another embodiment, the orifice plate is the same material as the barrier layer. The orifice plate can have a plurality of nozzles 319 through which fluid heated by the various resistors can be ejected for printing on a print media (not shown). The various layers can be formed, deposited, or attached upon the preceding layers. The configuration given here is but one possible configuration. For example, in an alternative embodiment, the orifice plate and barrier layer are integral.

The exemplary print cartridge 202 shown in FIGS. 2 and 3 is upside down from the common orientation during usage. When positioned for use, fluid (such as ink 302) can flow from the cartridge body 206 into one or more of the slots 304*a*–304*c*. From the slots, the fluid can travel through a fluid-handling passageway 320 that leads to an ejection chamber 322.

An ejection chamber 322 can be comprised of a firing resistor 316, a nozzle 319, and a given volume of space therein. Other configurations are also possible. When an electrical current is passed through the firing resistor in a given ejection chamber, the fluid can be heated to its boiling point so that it expands to eject a portion of the fluid from the nozzle 319. The ejected fluid can then be replaced by additional fluid from the fluid-handling passageway 320. Various embodiments can also utilize other ejection mechanisms.

FIGS. 4–10 show an exemplary process for forming fluid-handling slots in a substrate. The described embodiments can efficiently form a desired slot configuration.

Figure 4:
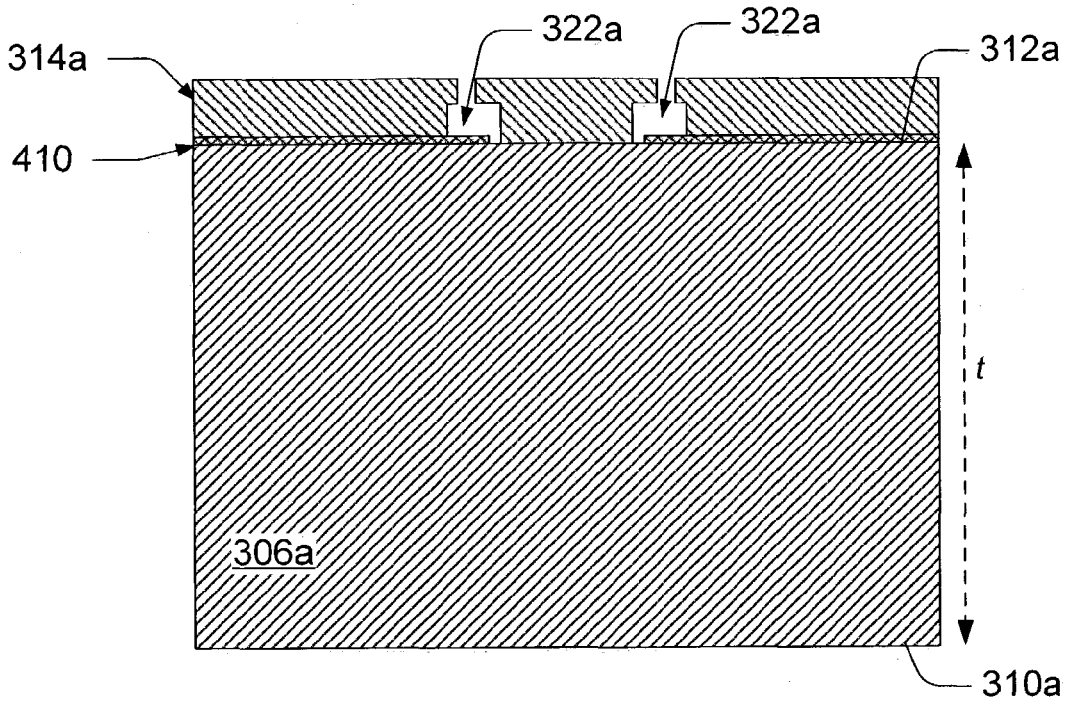
FIGS. 4–6 each show a cross-sectional view of a portion of an exemplary substrate in accordance with one embodiment.

FIG. 4 shows a cross-sectional view of a portion of an exemplary substrate 306*a* in accordance with one embodiment. The view is oriented similarly to the view shown in FIG. 3. The substrate has a first surface 310*a*, and a second surface 312*a*. In this example, the first and second surfaces are generally opposing and can define a thickness t of the substrate therebetween. As shown here, the first surface 310*a* can comprise a backside surface while the second surface 312*a* can comprise a thin film surface that has various thin film layers positioned upon it.

As shown in FIG. 4, a thin film or thin film layer 410 is formed over the second surface 312*a*. The thin film can comprise among others, a field or thermal oxide layer. As shown here, a barrier layer 314*a* is formed over the field oxide and at least partially defines firing chambers 322*a*. Other exemplary embodiments can have more layers comprising the thin film(s). Additionally or alternatively, other embodiments can form various layers over the thin film side during, or after the completion of, the slotting process. Still further embodiments can have some thin film(s) formed over the thin film side before the slotting process and can form additional layers during or after the slotting process.

Figure 5:
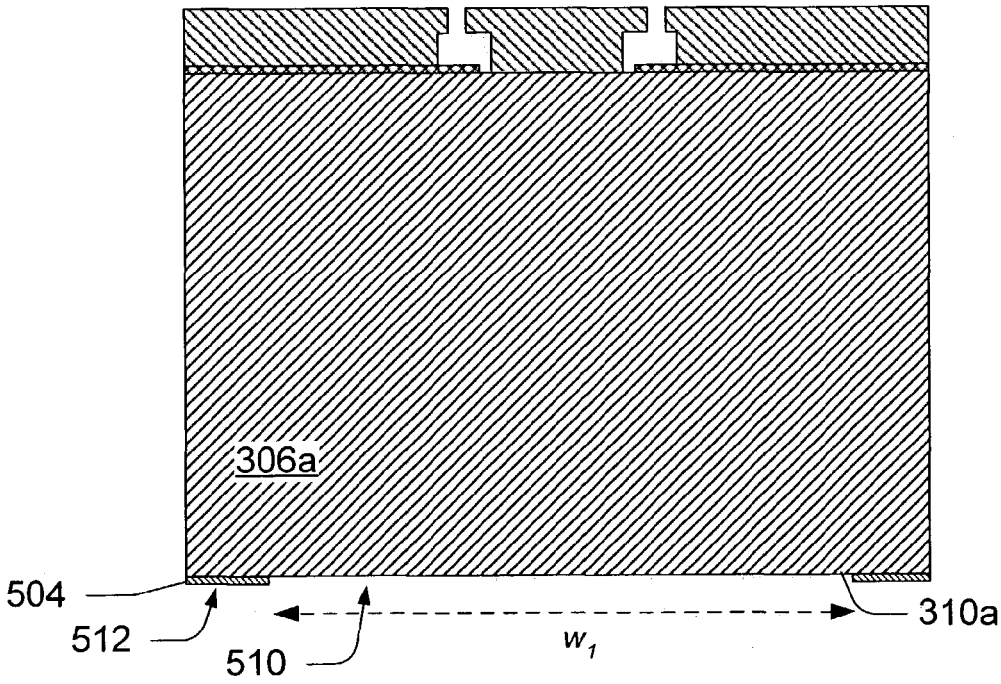

Referring to FIG. 5, a first patterned masking layer 504 is formed over the backside or first surface 310*a*, and patterned to expose a first area 510 that can comprise a desired area. Any suitable material can be used. In this example, the first patterned masking layer 504 can comprise a hard mask such as a thermal oxide. The first area 510 is generally free of hard mask material, while other portions shown generally at 512 have hard mask material formed thereover.

The hard mask can comprise any suitable material. Exemplary materials can have characteristics such that they are resistant to etching environments and do not produce polymeric residues during an etching process, and that are not removed by solvents used to remove photoresist materials during a slotting process. The hard mask can be grown thermal oxide or either grown or deposited dielectric material such as CVD (chemical vapor deposition) oxides, TEOS (tetraethoxysilane), silicon carbide, silicon nitride, or other suitable material. Other suitable masking materials can include, but are not limited to, aluminum, copper, aluminum-copper alloys, aluminum-titanium alloys, and gold.

The patterning of the hard mask, as shown here, can be accomplished in various suitable ways. For example, a photo-lithographic process can be utilized where the hard mask can be formed over generally all of the first surface and then hard mask material can be removed from the desired area such as the first area 510. Methods of removal can include either dry or wet processing.

Another suitable process includes patterning a first material on the desired area (such as first area 510) of the surface 310*a*. The hard mask can then be grown, deposited, or otherwise applied over the first surface. The first material can then be removed from the desired area leaving it free of hard mask material. The desired area can have a width $w_1$ in the range of about 100 to about 1000 microns and a length (not shown) corresponding to a length of a desired slot. In one exemplary embodiment, the desired area can have a width of about 350 microns. Slot lengths can range from less that about 1,000 microns to more than about 80,000 microns.

Figure 6:
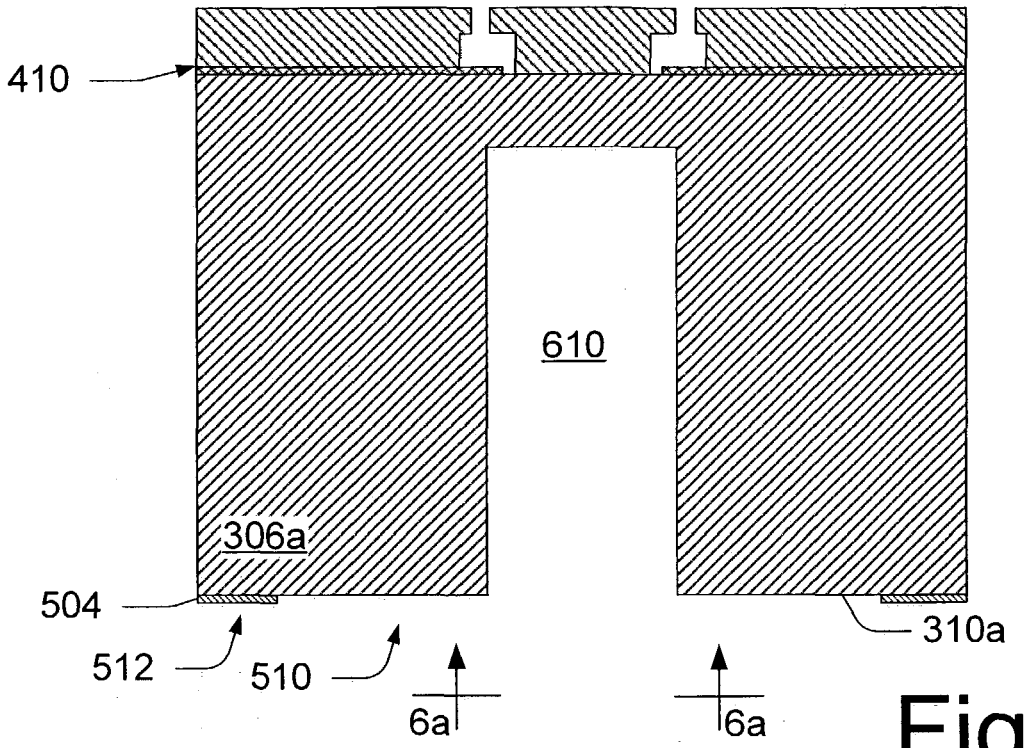
Figure 6A:
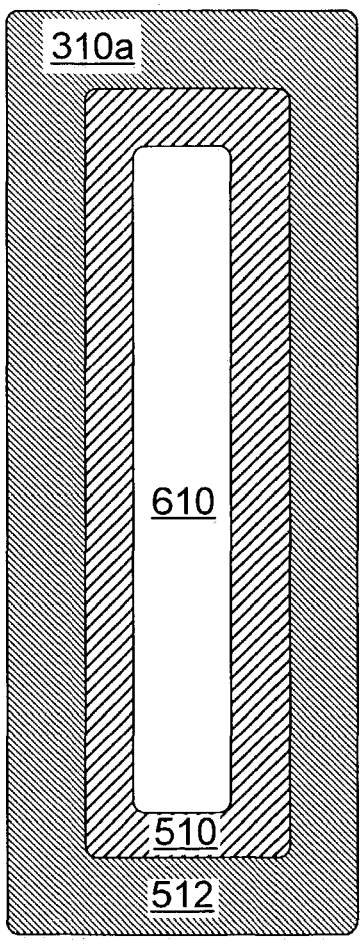
FIG. 6*a* shows a top view of a portion of an exemplary substrate in accordance with one embodiment.

Referring to FIG. 6, a slot portion 610 is formed or received into the substrate 306*a* through the first area 510 (of the first surface as shown in FIG. 5). In this example, the slot portion 610 can have a cross-sectional area at the first surface 310*a* that is less than the first area 510. FIG. 6*a* shows a view looking in the direction of arrows 6*a* in FIG. 6. In this example, the cross-sectional area of the slot portion 610 at the first surface 310*a* can be contained within the first area 510, though such need not be the case.

The slot portion 610 can be formed by any suitable technique including, but not limited to, laser machining, sand drilling, and mechanically contacting the substrate material. Mechanically contacting can include, but is not limited to, sawing with a diamond abrasive blade. As shown here, the slot portion can be formed through less than the entire thickness of the substrate. This allows the use of techniques that might otherwise be inappropriate for forming slots in a substrate that already has thin film layers formed thereon. For example, laser machining can be used to form the slot portion 610 since, in some embodiments, a portion of the thickness of the substrate 306*a* can be left to protect or buffer the thin film layers 410 from potentially damaging affects of the laser beam.

Figure 7:
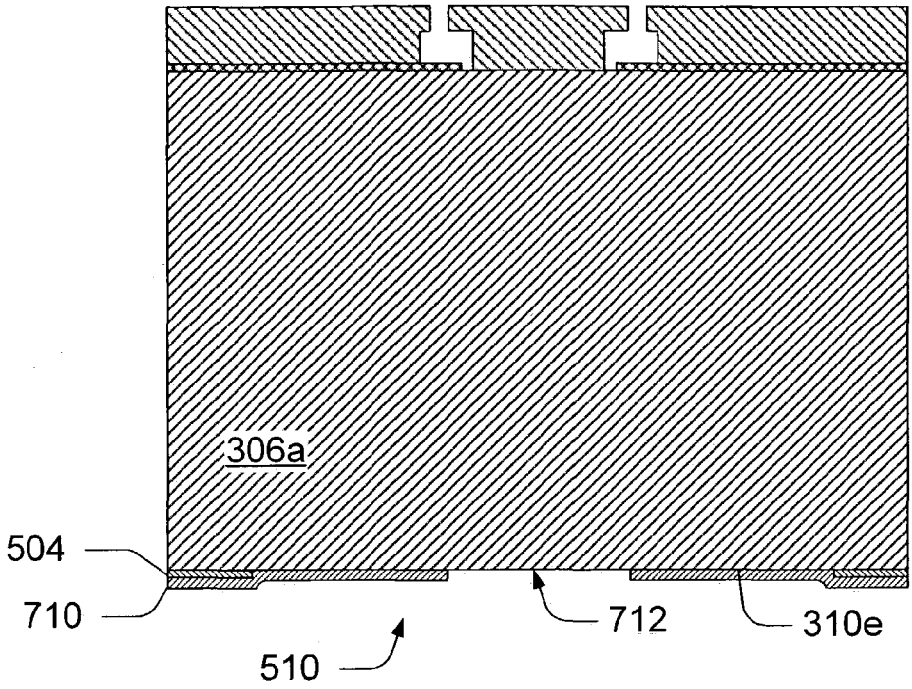
FIGS. 7–10 each show a cross-sectional view of a portion of an exemplary substrate in accordance with one embodiment.
Figure 8:
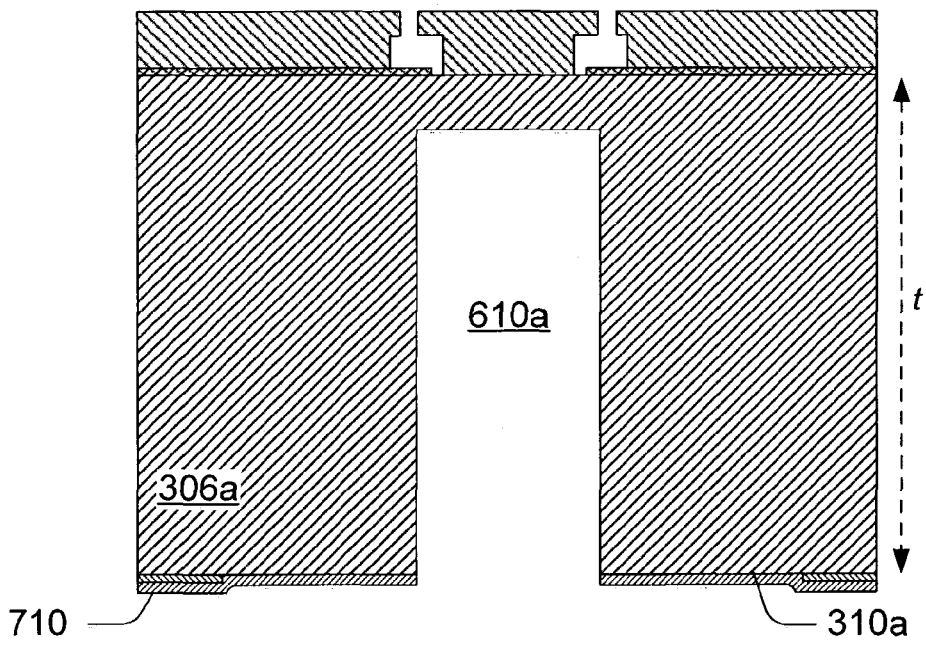
Figure 9:
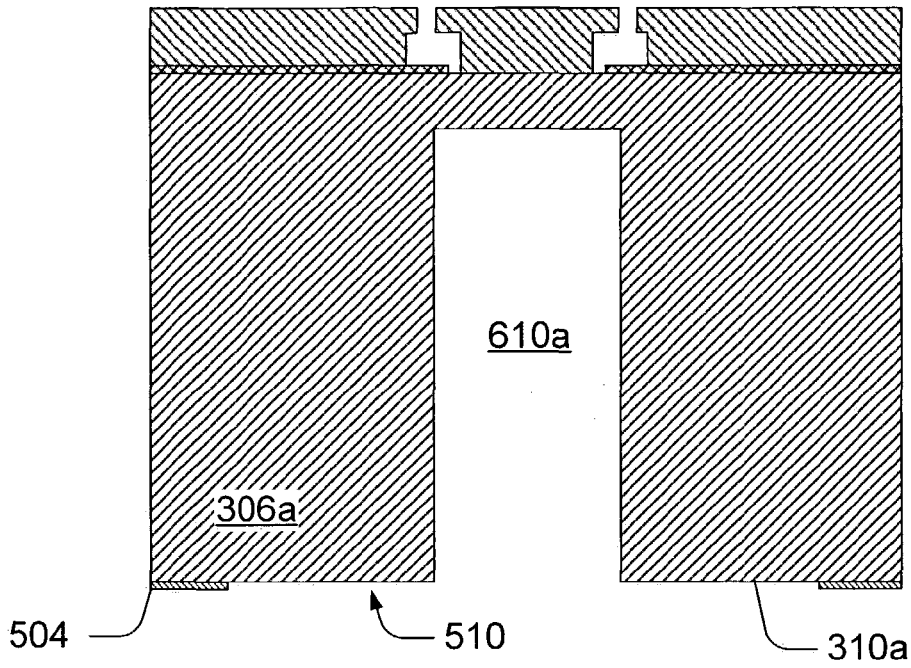

FIGS. 7–9 show an alternative technique for forming a slot portion in the substrate 306*a*. Referring to FIG. 7, a second patterned masking layer 710 is formed over the substrate 306*a* and patterned to expose at least some or a portion 712 of a desired area comprising the first area 510. In this example, the second patterned masking layer is formed over the first patterned masking layer 504. In this example, the second patterned masking layer 710 can comprise any suitable etch resistant material, such as a photoresist. The photoresist can be patterned in any conventional manner.

Referring to FIG. 8, a slot portion 610*a* is formed in the substrate 306*a* through the second patterned masking layer 710. In this example, the slot portion 610*a* can be formed by etching the substrate material. One exemplary etching technique comprises dry etching. Dry etching can include alternating acts of etching and passivating.

In some embodiments, the slot portion 610*a* can be dry etched into the substrate 306*a* through the second patterned masking layer (photoresist) 710. In one such embodiment, the slot portion 610*a* is etched through the exposed portion 712 (shown in FIG. 7) of the substrate's first surface 310*a*. In this embodiment, the second patterned masking layer 710 can define the slot portion boundaries at the first surface 310*a* as the slot portion 610*a* is etched into the substrate 306*a*.

The slot portion 610*a* can be etched to any suitable depth relative to the substrate thickness t. In various exemplary embodiments, this can range from less than about 50% to about 100% of the substrate's thickness t. In this example, the slot portion is etched through about 90% of the substrate's thickness. In another example, the slot portion passes through about 95% of the substrate's thickness.

Referring to FIG. 9, the second patterned masking layer 710 (shown in FIGS. 7 and 8) that comprises the-photoresist layer has been removed from the first surface 310*a* after the formation of the slot portion 610*a*. The photo-resist can be removed in any conventional manner known in the art. In this example, a portion of the first surface 310*a* still has the first patterned masking layer 504 comprising a hard mask formed on it. The exposed first area 510 now has a slot portion 610*a* formed through a sub-portion or sub-set thereof.

Figure 10:
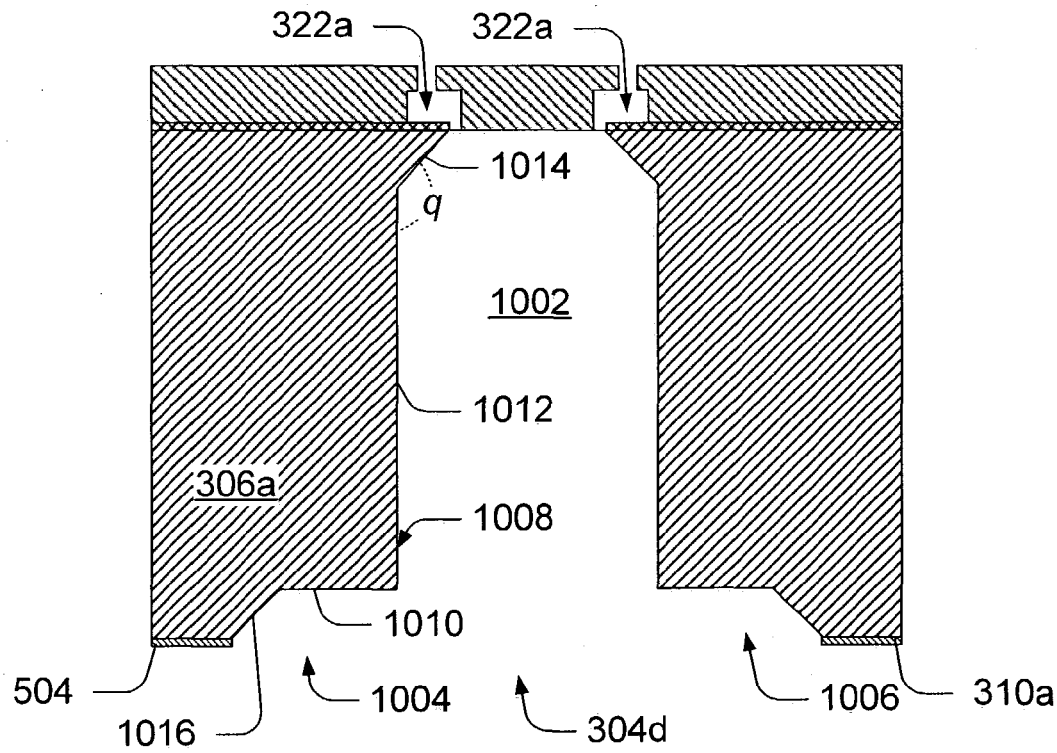

Referring to FIG. 10, additional substrate material is removed to form a slot 304*d* through the substrate 306*a*. In the example shown here, wet etching can be used to remove the additional substrate material. Wet etching can be achieved, in but one suitable process, by immersing the substrate 306*a* into an anisotropic etchant for a period of time sufficient to form the slot 304*d*. In one embodiment, the substrate can be immersed in an etchant such as TMAH (TetramethylamoniumHydroxide), among others, for a period of 1½ to 2 hours. Etchants may include any anisotropic wet etchant that has selectivity to hard masks and exposed thin film and other layers. As shown here, a single act of wet etching is utilized to remove the substrate material. In other embodiments, wet etching can comprise multiple acts of wet etching.

In this embodiment, the etchant removed substrate material to form a slot 304*d* that has a through region 1002 that is positioned between two shallow regions 1004 and 1006. In some embodiments, the slot 304*d* can have a sidewall 1008 that at least partially defines the slot. In some of these embodiments, the sidewall 1008 can have a first portion 1010 that is generally parallel to the first surface 310*a* and a second portion 1012 that is generally orthogonal to the first surface. In this example, the first portion 1010 can comprise a portion of one of the shallow regions (1004 and 1006) while the second portion 1012 can comprise a portion of the through region 1002. This exemplary configuration can avoid trapping bubbles formed in the firing chambers 322*a* as will be described in more detail below.

As shown in FIG. 10, the orthogonal and parallel surfaces, such as 1010 and 1012, can be formed by etching along <110> planes of the substrate 306*a*. The remaining sidewall portions, such as 1014 and 1016, that form obtuse angles relative to the <110> planes can be formed by etching along one or more <111> planes. An example of such an obtuse angle is shown relative to sidewall portions 1012 and 1014 and is labeled "q". The configuration of the patterned hard mask in conjunction with the width of the slot portion and the etching time can allow various suitable configurations to be achieved as will be recognized by the skilled artisan.

Existing technologies have formed slots by utilizing a combination of dry etching and wet etching. The process can form a re-entrant profile in the finished slot. Such a profile can cause bubble accumulation in the slot. An example of such a re-entrant profile can be seen in FIG. 11 which is a microscopy image of a hybrid slot 1102 formed in a substrate 1104.

Figure 11:
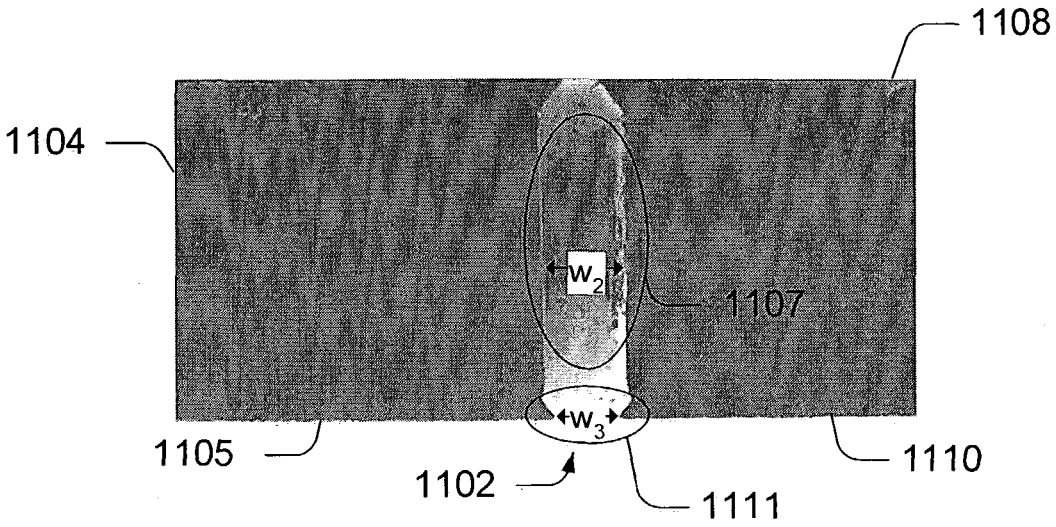
FIG. 11 shows a cross-sectional image of a prior art slotted substrate.

The slot 1102 shown in FIG. 11, was formed by dry-etching a slot portion through a hard mask covered first surface 1105 and then by wet etching. This technique created a majority of the slot shown generally as 1107 that has a generally uniform width $w_2$. When positioned for use in a printing device, a bubble or bubbles traveling generally away from a second surface 1108 toward the first surface 1110 can encounter a slot region 1111 that has a width $w_3$ that is less than $w_2$ that can trap the bubble(s) and occlude ink flow to some or all of the firing chambers (not shown).

Figure 12:
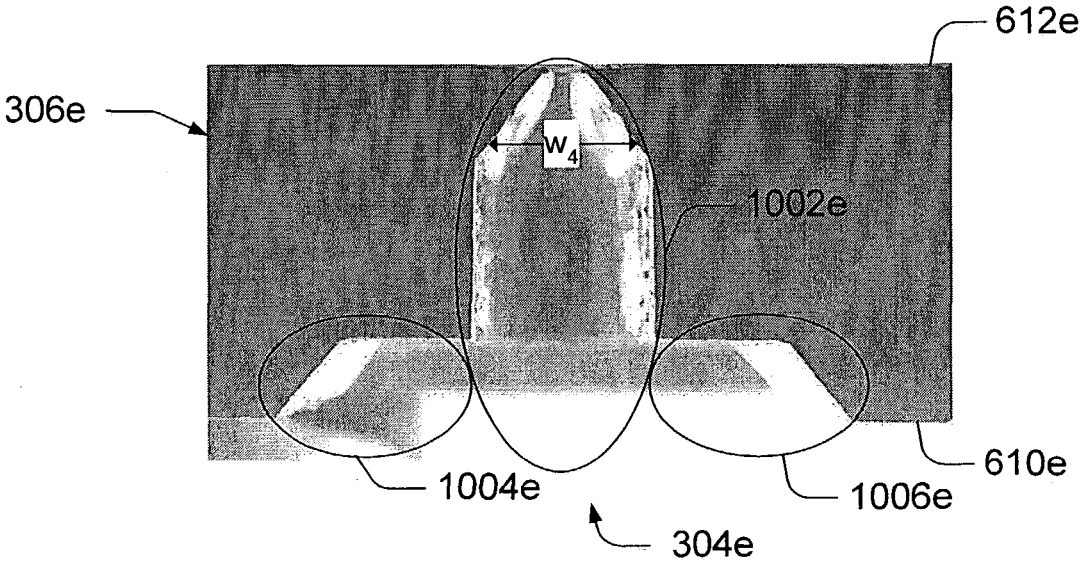
FIG. 12 shows a cross-sectional image of an exemplary slotted substrate in accordance with one embodiment.

FIG. 12 shows a microscopy image of an exemplary slotted substrate 306*e* formed in accordance with the embodiments described above. In this example some of the features described above are indicated generally. A slot 304*e* can include a through region 1002*e* positioned between shallow regions 1004*e* and 1006*e*. The through region 1002*e* can have a constant or increasing width $w_4$ starting at a second (thin film) surface 612*e* and traveling toward a first (backside) surface 610*e*. Such a configuration can allow gas bubbles to travel from the thin film side toward the backside and out of the substrate 306*e* when the substrate is positioned for use in a printing device.

Shallow regions, such as those shown in FIGS. 10 and 12, can reduce the likelihood that a finished print head will malfunction. For example, during the manufacturing process it is common to use glue or some other bonding material to bond the slotted substrate to the other components. The glue can seep into or otherwise clog the slots. Having a shallow region can alleviate this problem by allowing glue to accumulate in portions of the shallow region rather than in the through region of the slot wherein ink flow can be occluded. Further if the shallow regions have any reentrant portion or profile (i.e. at any point have a narrower cross-section moving from surface moving from surface 612*e* to surface 610*e*), there is a reduced chance of a bubble(s) blocking ink flow in the through region than prior designs.

In some of the present embodiments, the wet etching process etches or removes substrate material within the slot portion and proximate the slot portion on the first area of the first surface. Substrate removal techniques for forming the slot portion can be selected with regard to speed and efficiency of removal, while wet etching can finish the slot by selectively etching to the thin film layers. This can be achieved at least in part by the thin film layers slowing down the lateral progression of the etching along the <111> planes as described above. Utilizing wet etching to finish the slot(s) can also increase the strength of the resultant slotted substrate by reducing sharp edges, corners and other stress concentrating regions.

CONCLUSION

The described embodiments can efficiently form a slotted substrate. The slotted substrate can be formed utilizing two or more techniques for removing substrate material. The described process can be utilized to form a desired slot configuration. The slot configuration can, among other attributes, reduce failure of the slotted substrate to properly deliver fluid when incorporated into a print head die and/or other fluid-ejecting devices.

Although the invention has been described in language specific to structural features and methodological steps, it is to be understood that the invention defined in the appended claims is not necessarily limited to the specific features or steps described. Rather, the specific features and steps are disclosed as preferred forms of implementing the claimed invention.

What is claimed is:

1. A print head die forming method comprising:

forming a plurality of fluid-handling passageways and ejection chambers over a first surface of a substrate;

subsequent to said forming a plurality of fluid-handling passageways and ejection chambers, forming a first patterned masking layer sufficient to expose a desired area of a second generally opposing surface of the substrate;

after forming the first patterned masking layer, forming a second patterned masking layer sufficient to expose less than the entirety of the desired area of the second surface;

forming a slot portion in the substrate through the second patterned masking layer; and removing additional substrate material to form a fluid-handling slot sufficient to supply fluid from the second surface through the substrate to the first surface and the fluid handling passageways, the fluid-handling slot extending along a long axis that lies generally parallel to the first surface, wherein the fluid-handling slot has a cross-section taken transverse the long axis that is defined, at least in part, by one sidewall, wherein at least a first portion of the one sidewall is generally parallel to the first surface, and wherein a second portion of the one sidewall is generally perpendicular to the first surface, and wherein a third portion of the sidewall extends from the second portion to and in contact with the first surface of the substrate and defines an obtuse angle with the second portion as measured through the fluid-handling slot.

2. The method of claim 1, wherein said act of forming a first patterned masking layer comprises forming a hard mask.

3. The method of claim 1, wherein said act of forming a second patterned masking layer comprises forming a photoresist layer.

4. The method of claim 1, wherein said act of forming a slot portion comprises etching the slot portion.

5. The method of claim 1, wherein said act of removing forms a fluid-handling slot having a through region positioned between two shallow regions.

6. The method of claim 1, wherein said act of removing comprises wet etching the additional substrate material.

7. The method of claim 1 further comprising, after said act of forming a slot portion and before removing the additional substrate material, removing a portion of the second patterned masking layer.

8. A fluid-feed slot forming method comprising:

forming a plurality of fluid-handling passageways and ejection chambers over a first substrate surface;

subsequent to said forming a plurality of fluid-handling passageways and ejection chambers over a first substrate surface, patterning a hard mask on a generally opposing second substrate sufficient to expose a first area of the second surface;

forming a slot portion in the substrate through less than an entirety of the first area of the second surface, the slot portion having a cross-sectional area at the second surface that is less than a cross-sectional area of the first area; and after forming the slot portion, etching the substrate to remove material from within the first area to form a fluid-handling slot between the first and second surfaces sufficient to supply fluid to the fluid handling passageways, the fluid-handling slot extending along a long axis that lies generally parallel to the first substrate surface, wherein the fluid-handling slot has a cross-section taken transverse the long axis that is defined, at least in part, by one sidewall, wherein at least a first portion of the one sidewall is generally parallel to the first substrate surface, and wherein a second portion of the one sidewall is generally perpendicular to the first substrate surface, and wherein a third portion of the sidewall extends from the second portion to and in contact with the first substrate surface of the substrate and defines an obtuse angle with the second portion as measured through the fluid-handling slot.

9. The method of claim 8, wherein said act of forming a slot portion forms a slot portion having a cross-sectional area that comprises a subset of the first area.

10. The method of claim 8, wherein said act of patterning a hard mask comprises covering the entire second substrate surface with the hard mask and subsequently removing hard mask material from the first area of the surface.

11. A print head substrate forming method comprising:

forming a plurality of fluid-handling passageways and ejection chambers over a first substrate surface;

subsequent to said forming a plurality of fluid-handling passageways and ejection chambers, exposing a first portion of a second generally opposing substrate surface through a hard mask;

forming a photoresist over the hard mask and the first portion;

removing at least some of the photoresist to expose a second portion of the substrate surface through which a slot portion is to be formed;

dry etching the substrate through the photoresist sufficient to form the slot portion, and, after said dry etching, wet etching the substrate to form a fluid-handling slot through the substrate to supply fluid received at the second surface through the substrate and to the fluid-handling passageways and ejection chambers via the slot portion, the fluid-handling slot extending along a long axis that lies generally parallel to the first substrate surface, wherein the fluid-handling slot has a cross-section taken transverse the long axis that is defined, at least in part, by one sidewall, wherein at least a first portion of the one sidewall is generally parallel to the first substrate surface, and wherein a second portion of the one sidewall is generally perpendicular to the first substrate surface, and wherein a third portion of the sidewall extends from the second portion to and in contact with the first substrate surface of the substrate and defines an obtuse angle with the second portion as measured through the fluid-handling slot.

12. The method of claim 11, wherein said act of exposing comprises applying a hard mask over the entire substrate surface and removing hard mask material from over the first portion.

13. The method of claim 11, wherein said act of removing exposes a second portion that comprises a subset of the first portion.

14. The method of claim 11, wherein said act of removing exposes a second portion having an area that is less than an area of the first portion.

15. The method of claim 11, wherein said act of exposing comprises forming a hard mask over less than an entirety of the first surface.

16. The method of claim 11, wherein said act of wet etching comprises anisotropically etching the slot.

17. The method of claim 11, wherein said act of dry etching comprises alternating acts of etching and passivating.

18. A print head forming method comprising:

forming a fluid-handling slot extending between a thin-film surface of a substrate and a generally opposing backside surface of the substrate; the slot extending along a long axis that lies generally parallel to the thin-film surface, wherein the slot has a cross-section taken transverse the long axis that is defined, at least in part, by one sidewall, wherein at least a first portion of the one sidewall is generally parallel to the thin-film surface of the substrate, and wherein a second portion of the one sidewall is generally perpendicular to the thin-film surface, and wherein a third portion of the sidewall extends from the second portion to the and in contact with the thin-film surface of the substrate and defines an obtuse angle with the second portion as measured through the slot.

19. The method of claim 18, wherein said act of forming a fluid-handling slot in a substrate comprises:

forming a slot portion into the backside surface of the substrate; and, etching the substrate to remove substrate material proximate the slot portion to form the fluid-handling slot.

20. The method of claim 19, wherein said act of forming a slot portion comprises one or more of: laser machining and mechanically cutting.

21. The method of claim 19, wherein said act of forming a slot portion comprises multiple removal steps.

22. The method of claim 21, wherein at least one of the multiple removal steps comprises dry etching.

23. The method of claim 21, wherein at least one of the multiple removal steps comprises patterning a hard mask.

24. The method of claim 23, wherein said act of patterning a hard mask comprises a lift-off process.

25. The method of claim 19, wherein said act of etching comprises wet etching.

* * * * *